United States Patent [19]

Giller et al.

[11] Patent Number: 4,633,126

[45] Date of Patent: Dec. 30, 1986

[54] ELECTRIC REFLECTOR LAMP

[75] Inventors: Henricus F. J. I. Giller; Jacobus A. E. W. Heijboer, both of Eindhoven, Netherlands

[73] Assignee: U.S. Philips Corporation, New York, N.Y.

[21] Appl. No.: 814,524

[22] Filed: Dec. 19, 1985

Related U.S. Application Data

[63] Continuation of Ser. No. 504,549, Jun. 15, 1983, abandoned.

[30] Foreign Application Priority Data

Jul. 23, 1982 [NL] Netherlands ..... 8202971

[51] Int. Cl.[4] ..... H01J 5/16

[52] U.S. Cl. ..... 313/113; 313/114

[58] Field of Search ..... 313/113, 114, 117, 634; 362/293, 302

[56] References Cited

U.S. PATENT DOCUMENTS 2,146,181 2/1939 Greenmun ..... 313/113

2,622,222 12/1952 Hageman et al. ..... 313/114

3,038,372 6/1962 Lessman ..... 313/114

4,463,410 7/1984 Mori ..... 362/302

FOREIGN PATENT DOCUMENTS 1106209 of 1955 France ..... 313/114

*Primary Examiner*—David K. Moore

*Assistant Examiner*—K. Wieder

*Attorney, Agent, or Firm*—David R. Treacy

[57] ABSTRACT

The electric reflector lamp according to the invention has a blown glass lamp envelope, of which a concave internally mirror-coated wall portion, a translucent wall portion and a tubular wall portion constitute a single blow moulding. Within the lamp envelope is arranged a metal reflector body, which has a concave spherically curved reflecting surface facing the mirror-coated wall portion. Its axis and its center of curvature coincide with the axis and the focus, respectively, of the mirror-coated wall portion. A light source surrounds the focus. The lamp does not or substantially does not, emit stray light and concentrates the generated light very effectively.

22 Claims, 4 Drawing Figures

ELECTRIC REFLECTOR LAMP

This is a continuation of application Ser. No. 504,549, filed June 15, 1983, now abandoned.

The invention relates to an electric reflector lamp having a closed glass lamp envelope, which comprises a concave internally mirror-coated wall portion with an optical axis and a focus situated within the lamp envelope, a tubular wall portion extending from the apex of the mirror-coated wall portion to the exterior, and a translucent wall portion arranged opposite the mirror-coated wall portion, which wall portions form part of one blow moulding, the lamp further comprising a concave substantially spherically-curved mirror which faces the mirror-coated wall portion and whose axis and center of curvature substantially coincide with the axis and the focus, respectively, of the mirror-coated wall portion, a light source being arranged within the lamp envelope to surround the focus, from which light source current supply conductors are passed through the wall of the lamp envelope to the exterior, in which lamp those parts of the mirror-coated wall portion and of the spherically-curved mirror which throw light rays from the light source after at most two reflections onto the translucent wall portion surround the focus through a solid angle of at least 1.5 $\pi$ sr, while the spherically-curved mirror forms a mask which at least substantially prevents rays originating from the light source from reaching the translucent wall portion other than after reflection. Such a lamp is described in the non-prepublished British Patent application 8210535, to which U.S. Pat. No. 4,506,185 corresponds.

The lamp according to the said Patent Application concentrates the emitted light very effectively and moreover does not, or substantially does not, emit stray light. Consequently, the lamp delivers a light beam of high intensity, while nevertheless the lamp is comfortable for the user. The more effective the concentration of the light generated, the lower the power of a light source can be chosen in order to attain the same illumination intensity.

In the lamp according to that Application, the concave mirror-coated wall portion is substantially parabolic or substantially elliptic, the second focus of the ellipse being located outside the lamp envelope and the ellipse having an eccentricity lying between 0 and 0.9, the term eccentricity being understood to mean the ratio of the lengths of the minor and the major axis of the ellipse. An elliptic wall portion results in a converging beam so that even higher intensities can be obtained. By choosing a small distance between the foci of the ellipse, for example, 10 cm, the lamp obtains a comparatively wide beam which is comparable with that of the "flood" version of a PAR (pressed glass) lamp.

The substantially spherically-curved mirror in the lamp according to the said Patent Application is constituted by an internally mirror-coated wall portion of that shape. The translucent wall portion surrounds the spherical mirror-coated wall portion annularly. Thus, the lamp has a complicated form. When the mirror coatings are applied, the vapor source from which metal -aluminium, gold or silver- is deposted on the elliptic or parabolic wall portion and on the spherical wall portion should be positioned very accurately in order to achieve that a reflecting layer is deposited on these wall portions, but that such a layer is not deposited on the translucent wall portion.

The present invention has for its object to provide a lamp of the kind mentioned in the opening paragraph, the lamp envelope of which has a considerably simplified form and can be mirror-coated in a less critical manner, while nevertheless the lamp has at least the same favorable light-emitting properties.

According to the invention, in a lamp of the kind mentioned in the opening paragraph this is achieved in that the substantially spherically-curved mirror is a metal reflector body which is mounted within the lamp envelope and whose largest external diameter transverse to the axis is smaller than the internal diameter of the tubular lamp envelope portion in the region of the junction between the latter and the mirror-coated wall portion.

The use of a metal reflector body has great advantages as compared with the use of a mirror-coated wall portion. The metal reflector body is capable of withstanding a higher thermal load than glass. As a result, the reflector body can surround the light source more closely than a spherical mirror-coated wall portion. This results in that a metal reflector body screens to a smaller extent the concave internally mirror-coated wall portion around its apex.

For the sake of clarity, it should be noted that the metal reflector body has to be introduced as a separate lamp part through the tubular lamp envelope portion into the lamp and consequently has to be smaller than the opening provided near the apex in the concave (parabolic or elliptic) mirror-coated wall portion. In the lamp according to the invention, the reflector body does not screen or hardly screens, this mirror-coated wall portion at all. In general, this opening in the concave wall portion need not be larger, however, than without the use of a reflector body.

The use of a metal reflector body within the lamp envelope also results in that the lamp envelope may have a greatly simplified form, which in a coarse comparison does not differ from the lamp envelope of commercially available lamps having only one, annular parabolic or elliptic, mirror. The translucent wall portion closes completely the lamp envelope on the side of the mirror-coated wall portion arranged opposite the tubular wall portion and may have a uniformly curved outwardly bulged form as a result of which the lamp envelope has a large mechanical strength. The concave wall portion can be provided with a reflecting layer in a usual manner by vapor deposition.

Another consequence of the use of the reflector body is that, as compared with the lamp according to the Patent Application mentioned in the preamble, the number of rounded parts in the lamp envelope, which exert an optical influence, is smaller. Such rounded portions are present in the lamp according to said Application at the transition from the spherical mirror-coated wall portion to the translucent wall portion and at the transition from the latter wall portion to the concave mirror-coated wall portion. Such rounded portions reduce the solid angle through which the optically effective parts of the lamp envelope surround the light source.

In principle, the dimensions of the lamp envelope of the lamp according to the invention can be chosen arbitrarily. However, it must be possible to use the lamp in known lighting fittings and therefore the dimensions should not deviate excessively from, for example, those of ring mirror lamps. In practice, limitations are imposed thereby on the largest lamp envelope diameter, which are dependent inter alia upon the energy consumed by the lamp. In order to use effectively the space occupied by a lamp envelope, in a favorable embodiment of the lamp according to the invention, the concave mirror-coated wall portion is curved so that the diameter of the lamp envelope transverse to the optical axis at the area of the focal plane is at least 0.75 times the largest diameter transverse to the axis. In a very advantageous embodiment, the largest diameter exceeds by one to a few millimeters the diameter in the focal plane. A rounded transition between the mirrorcoated wall portion and the translucent wall portion can then be obtained without an optically unfavorable influence being exerted. The solid angle through which the cooperating parts of the mirror-coated wall portion and of the reflector body surround the focus and the center of curvature may reach very high values of, for example, 2.8 $\pi$ sr.

In the lamp according to the invention, the light source used may be constituted by a filament which may be surrounded by a glass inner envelope filled with a halogen-containing gas. Instead, a high-pressure discharge vessel provided with electrodes and an ionizable gas filling, for example a filling containing mercury or mercury and sodium or mercury and metal halides, may be used.

Since the part of the reflector body in the immediate vicinity of its intersection with the optical axis is optically not active in a useful manner, the reflector body may have at this area without objection a form deviating from the spherical form, for example, a protuberance in order to create, if required, space for an end of a coaxially-arranged discharge vessel. The reflector body may be secured near its apex to a currentsupply wire to this discharge vessel or to the discharge vessel itself. This also holds for the use of a filament in an inner envelope or for the use of a non-enveloped, for example coaxially stretched, filament. In lamps having a filament transversely stretched around the optical axis, the reflector body in a favourable embodiment is mounted on a rod which is secured to an electrically insulating body interconnecting within the lamp envelope the current-supply wires to the light source. This electrically insulating body may be a stem tube. The rod may then be secured by a clamping strip to the pinch at the end of the stem tube, but the rod may alternatively be sealed into this pinch or into a glass part which is secured to this pinch and in which support wires for the filament may also be accommodated. An advantage of establishing a connection between the reflector body and the light source is that these two parts can be aligned with respect to each other before they are introduced into the lamp envelope. However, the reflector body may alternatively be secured to the translucent wall portion by means of, for example, enamel or glue or by fusion.

The reflector body may be made of several metals, for example, of aluminium, chromium-nickel steel, or molybdenum. In a practical example, the reflector body is secured by fixing a tube made, for example, of a type 35 steel to the reflector body. The tube may have an upset edge and may project outwards through an opening in the reflector body, the upset edge bearing on the reflector body and the end of the tube projecting outwards being flanged over. A rod may be inserted into the tube and be secured therein by flattening the tube or by soldering or welding.

The concave mirror-coated wall portion may be curved uniformly, but alternatively a facetted or satined concave surface may be used. Thus, the light source may be prevented from being sharply displayed on an irradiated object in case the light source is not rotation-symmetrical to the axis of the lamp envelope. This may also be achieved in that the translucent wall portion is satined.

The lamp according to the invention may be used in a simple lamp holder because the lamp does not require an external screening. In order to ensure that the lamp can be used in a shallow lamp holder without light emanating from the tubular lamp envelope portion, the tubular wall portion may be made non-transparent, for example, by means of an internal mirror-coating or an external coating, for example, a layer of paint.

The tubular wall portion will generally have a smaller cross-section at its free end than near the mirror-coated wall portion. This is then due to the fact that the lamp envelope is closed by means of a stem tube and in that in making the fusion between the tubular wall portion and the stem tube, the tubular wall portion constricts at the area of the fusion. The conical end portion of the tubular wall portion obtained, is desirable in many cases in order to form an abutment for a lamp cap.

The lamp according to the invention may be used for creating an accent illumination. The lamp may then replace a combination of a bowl mirror lamp and a reflector, the lamp having the advantage that its mirror-coated wall portion, in contradistinction to the reflector of the combination, is not polluted by the surrounding air and that furthermore the lamp need not be aligned with respect to its lamp holder (and hence with respect to an external reflector).

The lamp may further be used instead of a ring mirror lamp with the great advantage that it does not or substantially does not emit unconcentrated light (stray radiation) and consequently is much more comfortable for the user and supplies a narrower beam. In most cases, the lamp according to the invention additionally concentrates the generated light much more effectively.

Moreover, the lamp may be used instead of a PAR (pressed glass) lamp with the advantages of a small weight, a more effective light concentration, no or substantially no stray radiation and, with respect to the manufacture, that during the manufacture no thermal treatments need be carried out in the immediate vicinity of mirrors, which could lead to damage of these mirrors.

The British Patent Application No. 803536 discloses a pressed glass lamp having a parabolic mirror-coated cup and a spherically curved reflector mounted within the lamp envelope. The center of curvature and the focus coincide and the filament surrounds these points. Besides the disadvantages pressed glass lamps generally have in comparison with lamps having a blown lamp envelope, namely a high weight, comparatively expensive glass, risk of damage (evaporation, oxidation) of the mirror during the provision of the cover of the lamp envelope, and the risk of rejects during the impact of ferrules, this known lamp moreover has the disadvantage that a very large part of the parabolic mirror is screened by the hemi-spherical shield, as a result of which the effectiveness of the lamp is very small.

From U.S. Pat No. 1,712,027, also a lamp is known having a parabolic mirror-coated wall portion with a filament in the focus. In the lamp envelope, an opaque shield is arranged in front of the filament in order to prevent direct emission of radiation from the lamp.

However, the shield may be colored or translucent so that it reduces the intensity of direct radiation.

Also in this lamp, the parabolic mirror surrounds the light source only through a small solid angle. Moreover, the shield does not contribute effectively to the concentration of the generated light.

A similar lamp with the same disadvantages is known from the Japanese Utility Model No. 44/7999.

Embodiments of the lamp according to the invention are shown in the drawings.

Figure 1:
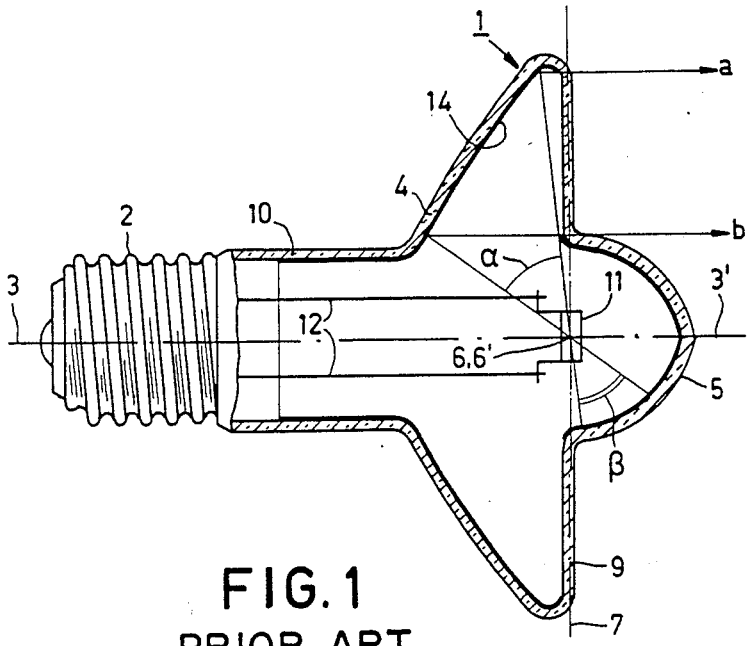
FIG. 1 PRIOR ART
FIG. 1 shows, partly in axial sectional view and partly in elevational view, a lamp according to the Patent Application mentioned in the opening paragraph.

The lamp shown in FIG. 1 has a blown glass lamp envelope 1 and a lamp cap 2. The lamp envelope 1 has a concave internally mirror-coated wall portion 4 having an optical axis 3, a focus 6 and a focal plane 7. Furthermore, the lamp envelope 1 has an internally mirror-coated substantially spherically-curved wall portion 5 whose center of curvature 6' and optical axis 3' coincide with the focus 6 and the optical axis 3, respectively, of the wall portion 4. An annular translucent wall portion 9 interconnects the two mirror-coated wall portions, while a tubular wall portion 10 extends from the apex of the wall portion 4 to the exterior. A light source 11 surrounds the focus 6 and the center of curvature 6'. Current-supply conductors 12 to the light source are passed to the exterior through the wall of the lamp envelope and are connected to the lamp cap 2.

The wall portions 4, 5, 9 and 10 of the lamp envelope 1 constitute one blow moulding. The lamp envelope has a complicated form. The substantially spherically-curved wall portion 5 optically co-operates with the concave wall portion 4. Light irradiated by the light source 11 within the solid angle $\alpha$ is concentrated by the mirror-coated wall portion 4 and is thrown to the outside through the translucent wall portion 9, just like the light irradiated within the solid angle $\beta$ after reflection at the spherically curved wall portion 5 and then at the wall portion 4. The light ray a is the outer and the light ray b the inner ray of the emitted beam. The hemispherical wall portion 5 constitutes a mask, as a result of which substantially only light rays reflected by the mirror-coated wall portions 4 and 5 can reach the translucent wall portion 9 and the lamp does not, or substantially does not, emit stray light.

It is visible in the Figure that of the concave mirror-coated wall portion 4 only the part 14 between the light rays a and b is optically effective. The part between the ray b and the axis 6 is screened by the wall portion 5, while the part between the ray a and the focal plane 7 is lost due to the rounded transition to the translucent wall portion. A rounded transition also exists between the hemispherical wall portion 5 and the translucent wall portion 9. During the metal vapor deposition on the wall portions 4 and 5, the metal vapor source has to be accurately positioned in order to attain that on the one hand the wall portions 4, 5, 10 are mirror-coated and consequently no stray light can leave the lamp envelope, but that on the other hand the translucent wall portion 9 is prevented from also being mirror-coated.

Figure 2:
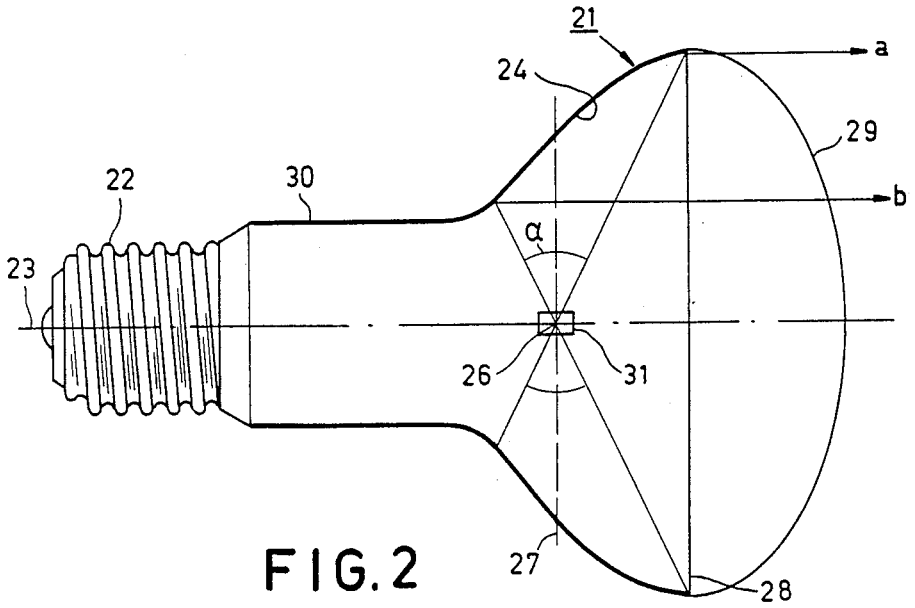
FIG. 2 PRIOR ART
FIG. 2 shows, partly in axial sectional view and partly in elevational view, a commercially available ring mirror lamp.

The known ring mirror lamp of FIG. 2 has a blown glass lamp envelope 21, a parabolic wall portion 24 of which has an optical axis 23 and, in a focal plane 27, a focus 26 around which a light source 31 is arranged. The lamp envelope has a tubular wall portion 30 which extends from the apex of the parabolic wall portion to a base 22 and a translucent wall portion 29. The wall portion 24 is internally mirror-coated as far as the largest diameter 28 of the lamp envelope and surrounds the light source through a solid angle $\alpha$ of 1.5 $\pi$ sr. The lamp has a reasonably large concentrating capacity for the generated light, but emits a large amount of stray radiation, as a result of which the lamp is not comfortable for the user, Moreover, a large amount of light is lost in the tubular lamp envelope part 30. The diameter of the lamp envelope at the area of the focal plane 27 is considerably smaller than the largest diameter transverse to the axis 23. The light rays a and b are the outer and the inner ray, respectively, of the concentrated light beam.

Figure 3:
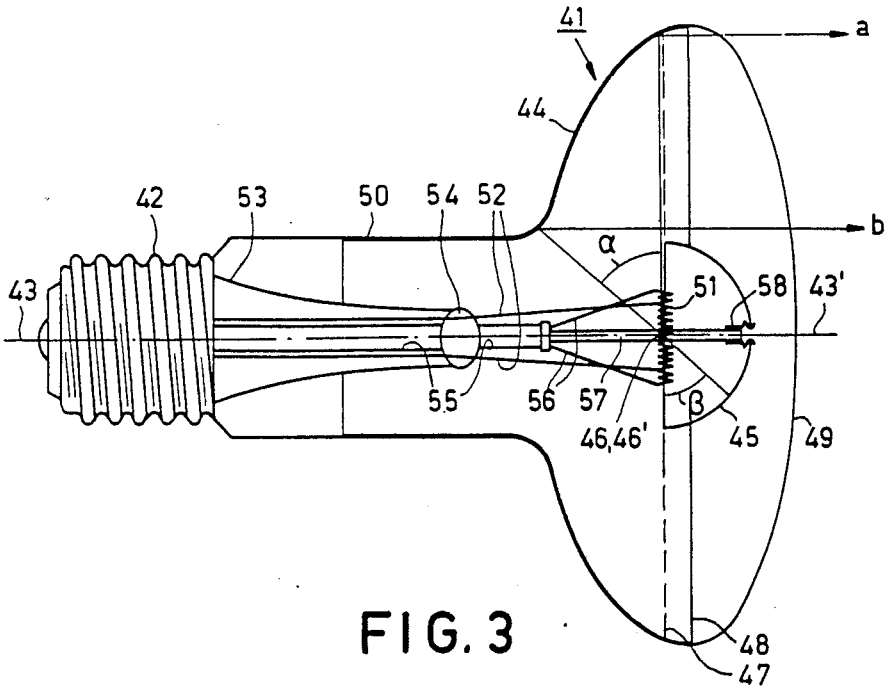
FIG. 3 shows, partly in axial sectional view and partly in elevational view, a first embodiment of the lamp according to the invention.

In FIG. 3, the lamp has a blown glass lamp envelope 41 having a concave internally mirror-coated wall portion 44, which has an optical axis 43 and a focus 46. From the apex of this—in this Figure parabolic—wall portion, a tubular wall portion 50 extends to the exterior, which latter wall portion carries at its free end a lamp cap 42. Opposite the mirror-coated wall portion 44 there is arranged a translucent wall portion 49. The mirror-coated wall portion 44, the tubular wall portion 50 and the translucent wall portion 49 from part of one blow moulding. Within the lamp envelope 41, a metal reflector body 45 is mounted, which has a concave substantially hemispherically curved reflecting surface which faces the mirror-coated wall portion 44 and whose centre of curvature 46' and axis 43' coincide with the focus 46 and the optical axis 43, respectively.

Within the lamp envelope, a filament 51 serving as light source is arranged to surround the focus 46. From this point, current-supply conductors 52 are passed through the wall of the lamp envelope 41 outwards to the lamp cap 42.

The metal reflector body 45 constitutes a mask which prevents light rays originating from the light source from reaching the translucent wall portion 49 other than after reflection. The optically co-operating parts of the reflector body 45 and the mirror-coated wall portion 44, which throw radiation originating from the light source 51 after at most two reflections onto the translucent wall portion 49, together surround the focus 46 through a solid angle $(\alpha+\beta)$ of at least 1.5 $\pi$ sr, in the FIG. 2.8 $\pi$ sr. The largest external diameter of the reflector body 45 transverse to its axis is smaller than the internal diameter of the tubular wall portion 50 in the region of its junction with the mirror-coated wall portion 44. The reflector body then does not screen parts of the mirror-coated parabolic wall portion near its apex. At its free end the tubular wall portion 50 is fused with a stem tube 53, as a result of which the diameter of this wall portion is reduced at this area and an abutment for the lamp cap 42 is obtained.

The lamp envelope 41 has a simple form. The translucent wall portion 49 has an evenly curved outwardly bulged form, while it passes with an even curvature into the parabolically curved wall portion 44. The lamp envelope 41 has a large mechanical strength. The reflecting layer on the parabolic wall portion 44 extends beyond the focal plane 47 as far as the largest diameter 48 transverse to the axis 43,43'. The mirror-coating is provided in a usual manner by evaporation of aluminium in vacuo and by subsequently etching away the metal deposited on the translucent wall portion. However, according to an alternative method, the metal vapor source is screened so that no metal is deposited on the translucent wall portion.

The diameter of the lamp envelope 41 at the area of the focal plane 47 is a few millimeters, for example 3 mms, smaller than the largest diameter 48. The ratio of these diameters is approximately 0.97. The rounded transition from the parabolically curved wall portion 44 to the translucent wall portion 49 is located beyond the focal plane and does not reduce the effective surface of the mirror-coated wall portion. Due to this fact inter alia, the co-operating reflecting surfaces of the lamp surround the light source 51 through a large solid angle.

The stem tube 53 is closed by a pinch 54, into which a glass exhaust tube 55 is pinches which extends still further into the lamp envelope 41. At the end of the exhaust tube 55, support wires 56 for the filament and a metal rod 57 carrying the reflector body 45 are embedded. At the area at which the axis 43,43' intersects the reflector body 45, in this body a metal tube 58 is arranged, which ensures that the reflector body is enclosed between an upset edge on the inner side of this body and a flanged end on the outer side. The rod 57 projects into this tube 58 and is secured therein.

Figure 4:
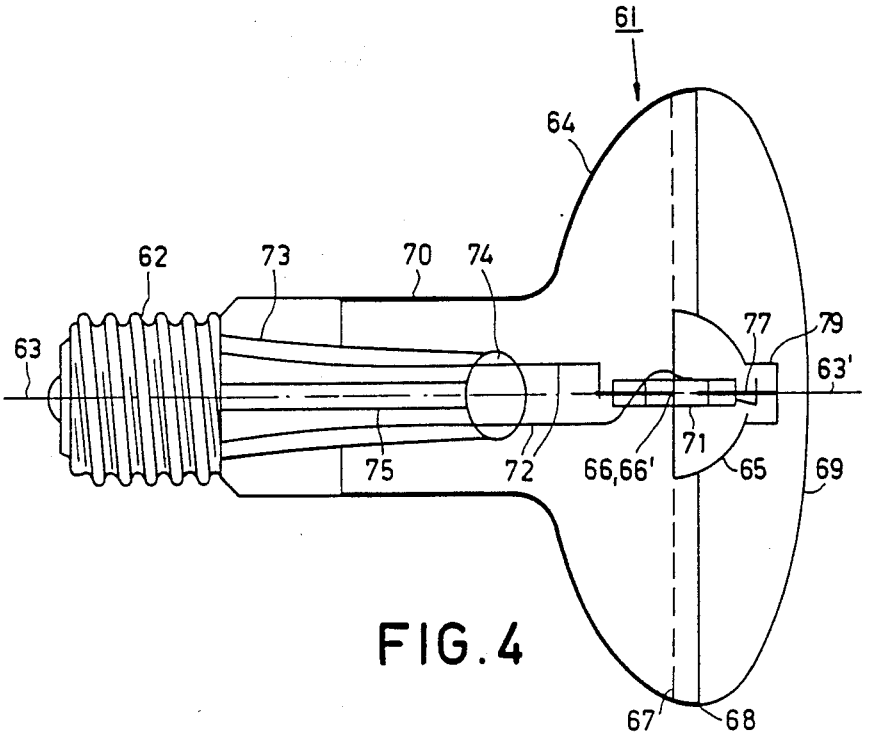
FIG. 4 shows, partly in axial sectional view and partly in elevational view, a second embodiment of the lamp according to the invention.

In FIG. 4 there is shown a lamp 61 having parts corresponding to the lamp of FIG. 3 which have reference numerals which are 20 higher than in FIG. 3. The light source 71 in this Figure is a discharge vessel with a high-pressure sodium vapor discharge. The reflector body 65 has a protuberance 79 to create space for the discharge vessel. The body is secured to a rod 77, which supplies current to the discharge vessel.

What is claimed is:

1. A glare-free electric reflector lamp, comprising:

a closed glass lamp envelope, having a concave internally-mirror-coated wall portion having an apex, said mirror-coated portion having a shape which defines an optical axis, a focus and a focal plane situated within the lamp envelope; a tubular wall portion extending from the apex of the mirror-coated wall portion to the exterior; and a translucent wall portion arranged opposite the mirror-coated wall portion, said wall portions forming part of one blow molding, a concave curved mirror facing said mirror-coated wall portion, substantially coaxial therewith, and having its center of curvature substantially coinciding with the focus of the mirror-coated wall portion, those portions of said mirror-coated wall portion and said concave curved mirror, which cooperate to throw light rays onto said translucent wall portion, together having a total solid angle surrounding the focus of at least 1.5 $\pi$ sr, and a light source disposed within said envelope, surrounding said focus, characterized in that said mirror-coated wall portion extends substantially from said tubular portion to beyond said focal plane, said concave curved mirror is a hemispheric mirror which forms a mask, and at least substantially completely prevents light rays originating from said light source from reaching said translucent wall portion without being reflected at least once, and said hemispheric mirror is a metal reflector body mounted within said lamp envelope, having a largest external diameter, transverse to the axis, which is smaller than the internal diameter of said tubular lamp envelope portion, whereby substantially all light rays passing through said translucent wall portion pass generally in the same direction as said axis.

2. An electric reflector lamp as claimed in claim 1, wherein the diameter of the lamp envelope transverse to the optical axis at the area of the focal plane is at least 0.75 times the largest diameter transverse to the axis.

3. An electric reflector lamp as claimed in claim 2, characterized in that the largest diameter exceeds by one to a few millimeters the diameter at the area of the focal plane.

4. An electric reflector lamp as claimed in claim 1, characterized in that the reflector body is mounted on a rod at the area at which it is intersected by the optical axis.

5. An electric reflector lamp as claimed in claim 4, characterized in that the rod is a current-supply conductor to the light source.

6. An electric reflector lamp as claimed in claim 4, characterized in that the rod is secured to an inner envelope of the light source.

7. An electric reflector lamp as claimed in claim 4, characterized in that the rod is secured to an electrically insulating body interconnecting the current-supply conductors within the lamp envelope.

8. An electric reflector lamp as claimed in claim 7, characterized in that the electrically insulating body is the pinch of a stem tube.

9. An electric reflector lamp as claimed in claim 7, characterized in that the electrically insulating body is a glass part which is connected to the pinch of a stem tube and in which support wires are secured for a filament which constitutes the light source.

10. An electric reflector lamp as claimed in claim 2, characterized in that the largest diameter exceeds by one to a few millimeters the diameter at the area of the focal plane.

11. An electric reflector lamp as claimed in claim 4, characterized in that the rod is a current-supply conductor to the light source.

12. An electric reflector lamp as claimed in claim 4, characterized in that the rod is secured to an inner envelope of the light source.

13. An electric reflector lamp as claimed in claim 4, characterized in that the rod is secured to an electrically insulating body interconnecting the current-supply conductors within the lamp envelope.

14. An electric reflector lamp as claimed in claim 7, characterized in that the electrically insulating body is the pinch of a stem tube.

15. An electric reflector lamp as claimed in claim 7, characterized in that the electrically insulating body is a glass part which is connected to the pinch of a stem tube and in which support wires are secured for a filament which constitutes the light source.

16. A glare-free electric reflector lamp, comprising:

a closed glass lamp envelope, having a concave internally-mirror-coated wall portion having an apex, said mirror-coated portion having a shape which defines an optical axis, a focus and a focal plane situated within the lamp envelope; a tubular wall portion extending from the apex of the mirror-coated wall portion to the exterior; and a translucent wall portion arranged opposite the mirror-coated wall portion, said wall portions forming part of one blow molding, a concave curved mirror facing said mirror-coated wall portion, substantially coaxial therewith, and having its center of curvature substantially coinciding with the focus of the mirror-coated wall portion, those portions of said mirror-coated wall portion and said concave curved mirror, which cooperate to throw light rays onto said translucent wall portion, together having a total solid angle surrounding the focus of at least 1.5 $\pi$ sr, a light source disposed within said envelope, surrounding said focus, and current-supply conductors extending from said light source within said tubular wall portion, and passing through the wall of the lamp envelope to the exterior, characterized in that said mirror-coated wall portion extends substantially from said tubular portion to beyond said focal plane, said concave curved mirror is a substantially-spherically-curved metal reflector, mounted within said envelope, which forms a mask, and at least substantially completely prevents light rays originating from said light source from reaching said translucent wall portion without being reflected at least once, and light rays emanating from said source and passing through said translucent wall portion consist of a first set and a second set; said first set consists of rays emanating from said source, being reflected once from said internally mirror-coated portion and then passing out through said translucent wall portion; and said second set of rays passing from the light source to the substantially-spherical-curved mirror, being reflected thereby to the concave internally mirror-coated wall portion, and then being reflected and passing out through said translucent wall portion.

17. An electric reflector lamp as claimed in claim 5, where the reflector body is substantially hemi-spherical.

18. An electric reflector lamp as claimed in claim 5, wherein the diameter of the lamp envelope transverse to the optical axis at the area of the focal plane is at least 0.75 times the largest diameter transverse to the axis.

19. An electric reflector lamp as claimed in claim 5, characterized in that the reflector body is mounted on a rod at the area at which it is intersected by the optical axis.

20. A glare-free electric reflector lamp, comprising:

a closed glass lamp envelope, having a concave internally-mirror-coated wall portion having an apex, said mirror-coated portion having a shape which defines an optical axis, a focus and a focal plane situated within the lamp envelope; and a translucent wall portion arranged opposite the mirror-coated wall portion, a concave curved mirror facing said mirror-coated wall portion, substantially coaxial therewith, and having its center of curvature substantially coinciding with the focus of the mirror-coated wall portion, those portions of said mirror-coated wall portion and said concave curved mirror, which cooperate to throw light rays onto said translucent wall portion, together having a total solid angle surrounding the focus of at least 1.5 $\pi$ sr, a light source disposed within said envelope, surrounding said focus, and current-supply conductors extending from said light source within said tubular wall portion, and passing through the wall of the lamp envelope to the exterior, characterized in that said mirror-coated wall portion extends substantially from said apex to beyond said focal plane, said concave curved mirror is a substantially-hemispherically metal reflector, mounted within said envelope, which forms a mask, and at least substantially completely prevents light rays originating from said light source from reaching said translucent wall portion without being reflected at least once, the diameter of the lamp envelope transverse to the optical axis at the area of the focal plane is at least 0.75 times the largest diameter transverse to the axis, and light rays emanating from said source and passing through said translucent wall portion consist of a first set and a second set; said first set consists of rays emanating from said source, being reflected once from said internally mirror-coated portion and then passing out through said translucent wall portion; and said second set of rays passing from the light source to the substantially-spherical-curved mirror, being reflected thereby to the concave internally mirror-coated wall portion, and then being reflected and passing out through said translucent wall portion.

21. A lamp as claimed in claim 20, characterized in that said light source comprises a tungsten halogen source having a glass inner envelope.

22. A lamp as claimed in claim 21, characterized in that said spherically-curved mirror is mounted on a rod at the area at which it is intersected by the optical axis, and said rod is secured to said inner envelope.

* * * * *